United States Patent [19]

Lamy

[11] Patent Number: 4,792,171

[45] Date of Patent: Dec. 20, 1988

[54] DEVICE FOR MANEUVERING LARGE CAPACITY BAGS FILLED WITH POWDERED OR GRANULAR MATERIALS

[75] Inventor: Jean-Pierre Lamy, Paris, France

[73] Assignee: Mecaroute S.A., Boulogne-Billancourt, France

[21] Appl. No.: 92,261

[22] Filed: Sep. 2, 1987

[30] Foreign Application Priority Data

Sep. 3, 1986 [FR] France ..... 86 12378

[51] Int. Cl.[4] ..... B65D 33/14; B65D 90/20

[52] U.S. Cl. ..... 294/68.3; 248/95; 294/67.1; 383/6; 414/608

[58] Field of Search ..... 294/67.1, 67.4, 68.1, 294/68.3, 74, 81.5, 81.1; 108/51.1, 51.3, 52.1, 57.1; 141/114, 166, 231, 314, 316, 331, 369, 375; 206/386, 596, 598, 599; 248/95, 97, 99, 100, 101; 383/6, 7, 12, 13, 22, 24, 36; 414/607, 608

[56] References Cited

U.S. PATENT DOCUMENTS

| | | | |
|---|---|---|---|
| 1,414,575 | 5/1922 | McCart | 248/97 |
| 2,696,317 | 12/1954 | Toffolon | 294/74 X |
| 3,028,895 | 4/1962 | Gooding | 383/22 |
| 3,131,832 | 5/1964 | Strandberg et al. | 383/7 X |
| 3,520,258 | 7/1970 | Shephard | 108/57.1 X |
| 4,143,796 | 3/1979 | Williamson et al. | 248/95 X |
| 4,240,474 | 12/1980 | Perkins | 248/101 X |
| 4,300,608 | 11/1981 | Cuthbertson | 383/7 |

FOREIGN PATENT DOCUMENTS

| | | | |
|---|---|---|---|
| 109191 | 5/1984 | European Pat. Off. | 414/608 |
| 1251212 | 9/1967 | Fed. Rep. of Germany | 383/6 |
| 2564440 | 11/1985 | France . | |
| 2150538 | 7/1985 | United Kingdom | 383/6 |

*Primary Examiner*—Johnny D. Cherry

*Attorney, Agent, or Firm*—Sughrue, Mion, Zinn, Macpeak and Seas

[57] ABSTRACT

Device for maneuvering large capacity bags filled with powdered or granular materials wherein a square 6 formed from four tubes 11–14 is placed on the bag, the cross-pieces 9 formed by the ends of the tubes being engaged in the straps 2–5 of the bag. The forks of a forklift truck can be inserted in two parallel tubes enabling the bag to be maneuvered without risk of overturning, without the truck driver leaving his seat and without the help of another person. Equipped with an annular accessory 18 forming a support for the funnel 21 of a bag 20 which can be locked onto the inner sides of the tubes so that is inscribed in the square, one of the major applications of the device according to the invention is the robotization of the emptying and filling of flexible containers.

5 Claims, 3 Drawing Sheets

DEVICE FOR MANEUVERING LARGE CAPACITY BAGS FILLED WITH POWDERED OR GRANULAR MATERIALS

BACKGROUND OF THE INVENTION

1. Field of the Invention

The object of the present invention is a device for maneuvering objects such as large capacity bags filled with a wide variety of materials, for example but not limited to, bags of powdered or granular products such as those described in French Pat. No. 2 564 440.

2. Description of the Prior Art

The bags to be maneuvered are generally equipped with belts, straps, handles or slings enabling the hooks of hoists, cranes or other lifting equipment to be attached to them. This requires the presence of an operative other than the driver of the lifting equipment or requires the driver of the lifting equipment to leave his position.

A particular object of the invention is the maneuvering of such bags using forklift trucks. The driver cannot engage the fork elements in the lifting straps of the bags without the help of an assistant, or without leaving the driving seat. If the fork elements are inserted beneath the bag, there is a risk of overturning it.

SUMMARY OF THE INVENTION

The present invention concerns a device for picking up bags using a forklift truck, without the driver having to leave his seat.

To achieve this result, the object of the present invention is a device for maneuvering bags equipped with lifting straps, filled with powdered or granular materials, characterized in that it comprises a substantially flat rigid element encompassing at least two parallel tubes open at both ends, capable of receiving the fork elements of a forklift truck, wherein the ends of the tubes project to enable the straps of the bags to be passed over them.

Advantageously the flat rigid element comprises four tubes disposed in a square, wherein the intersections of the tubes with their ends projecting enable the straps of the bags to be passed over them.

The area of the flat rigid element will substantially correspond to the horizontal section of a bag to be lifted, apart from the ends of the tubes which extend to provide a secure attachment means.

In one embodiment, the rigid element is associated with a toroidal rigid accessory the outer diameter of which is slightly less than that of the central opening of said rigid element, locking means being provided to enable said accessory to be held inscribed in said central opening of said rigid element.

In this context a torus is understood to be a "surface of revolution generated by a curve which rotates about an axis located in its plane and not passing through its center." A priori, said torus can be any torus but is advantageously open, that is such that said curve is not closed, and can, for example, by rotating, generate an annular groove the sides of which are substantially concentric and of different diameters. Amongst other advantages, this configuration offers that of being able to stack such accessories one inside the other. It will be shown later in the disclosure how this is advantageous in the use of the device according to the invention.

Said accessory is designed to facilitate the filling of a bag of the type described above and equipped at the top with a flexible funnel in the form of a sleeve, said sleeve extending from the top of the bag, between it straps, terminating in an advantageously circular opening, of a diameter slightly greater than the inner diameter of the central opening of said annular grooved accessory.

Said locking means can comprise a groove or recess disposed circumferentially on the radially outer part of said accessory, cooperating with protuberances in the form of convex surfaces formed on the inner part of said element and extending radially inwards. Advantageously, said accessory is of substantially the same height as said rigid element, hardly extending above said rigid element when it is in place, inscribed in the central opening of said rigid element.

It is thus possible to lock said accessory into said rigid element if convex surfaces are formed on the inner sides of the tubes of said rigid element, the outer diameter of said accessory being matched to the inner dimensions of said rigid element.

When a bag equipped with a funnel as described above, the opening of which has a diameter slightly greater than the inner diameter of said rigid accessory, has its straps passed around the projecting ends of the tubes of said element equipped with such an accessory, the flexible funnel is passed inside the central opening of said accessory and the upper edge of the funnel is circumferentially folded into said annular groove.

It is even possible to wedge the upper edge of the funnel between a first and a second identical rigid accessory of the type described above. To do so, with the first accessory already in place with the upper edge of said funnel circumferentially folded into its groove, the two accessories are nested one inside the other by bringing them together after laying one above the other in their planes and causing their axes of revolution to coincide.

Other objects and advantages will appear from the following description of an example of the invention, when considered in connection with the accompanying drawings, and the novel features will be particularly pointed out in the appended claims.

BRIEF DESCRIPTION OF THE DRAWINGS

FIG. 7 is a view in cross-section of the device on the plane indicated V—V in FIG. 6.

DESCRIPTION OF THE PREFERRED EMBODIMENT

Figure 1:
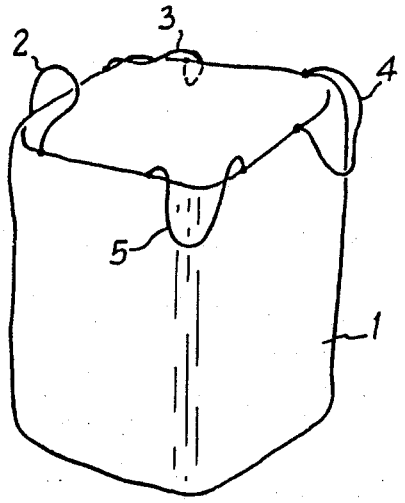
FIG. 1 is a perspective view of a type of bag to which the invention can apply.

In different types of industry, flexible containers or bags 1 of the type shown in FIG. 1 are used to maneuver, store, clear away, etc, all sorts of powdered or granular products such as earth, sand, gravel, fertilizer, chemicals, grain, etc. These bags incorporate lifting straps 2, 3, 4, 5, in which can be inserted the hooks of cranes, the fork elements of forklift trucks, etc.

When a bag is full, it generally appears as shown in FIG. 1. In this form, it is not possible to insert a hook or a fork element into the straps without manual assistance.

Figure 3:
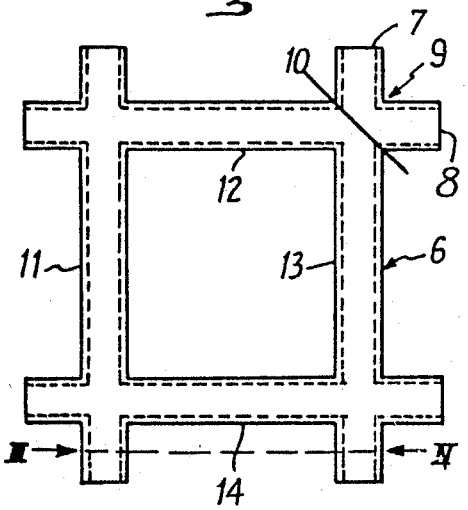
FIG. 3 is a plan view of an example of the device according to the invention.

According to the invention, a square device 6 in the form of four tubes 11, 12, 13, 14, of rectangular section arranged in a square in the same plane, at right angles to each other, is positioned in the straps of the bag. The tubes extend so that their ends 7, 8 (FIG. 3) extend the sides of the square beyond the corners, to form stop elements in the form of cross-pieces 9 linked to the square via areas 10 of narrow section (FIG. 3) to constitute attachment means. The dimensions of the square 6 correspond substantially to the horizontal dimensions of the bag 1. The tubular sides of the square are unobstructed from one end to the other on each side and open at both ends.

Figure 2:
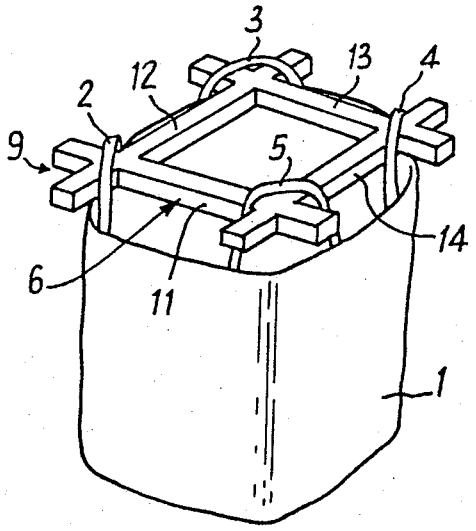
FIG. 2 is a view in perspective of a bag of the type in FIG. 1, equipped with a device according to the invention.
Figure 4:
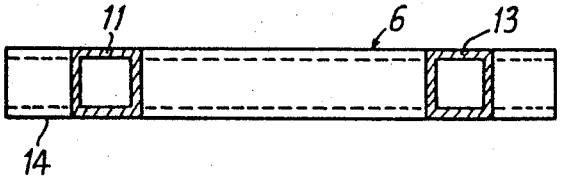
FIG. 4 is a view in cross-section on the plane indicated IV—IV in FIG. 3.

The device according to the invention is used in the following manner. The square 6 is placed on top of a full bag and the straps 2, 3, 4, 5 are passed over the cross-piece 9 into the attachment areas 10, as shown in FIG. 2. It is then a simple matter to insert into the tubes 11 and 13, or 12 and 14, from either end, the fork or tine elements of a forklift truck, the spacing of which has previously been appropriately set. The bag can then be easily maneuvered by the truck driver, without having his seat, and without the help of another person.

Figure 5:
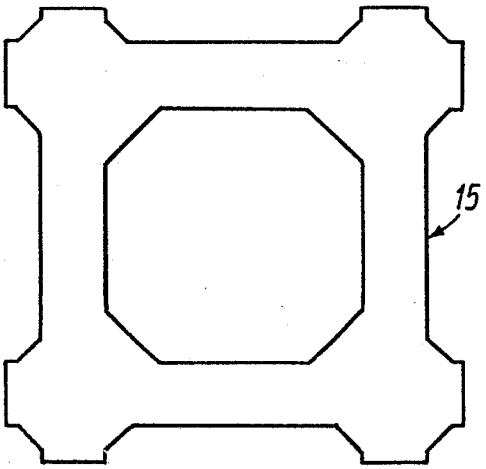
FIG. 5 is a plan view of a variant.

FIG. 5 is a plan view of another embodiment of a crossed square 15 according to the present invention.

The device according to the invention can be fabricated from any suitable material: wood, metal, plastics material. Plastics material offers the advantage of being cheaper. It will be noted that the material of the cross-piece is practically unstressed in operation. Only the tops of the attachment areas 10 are subject to compression between the straps 2, 3, 4, 5 and the fork elements of the forklift truck engaged in the tubes 11, 12, 13, 14. The bottoms of the cross-pieces are completely unstressed while the bag is being maneuvered (the upper and lower parts are identical, the cross-pieces having no specific top or bottom to ensure simplicity of use). The under part with the sides serves mainly as a guide for the fork elements and helps to hold them in place correctly during maneuvering.

It will be understood that the maneuvering device has at least two parallel tubes and a square shape with four tubes is very suitable. A shape with six or more sides would offer no appreciable advantage and would complicate the manufacture.

Figure 6:
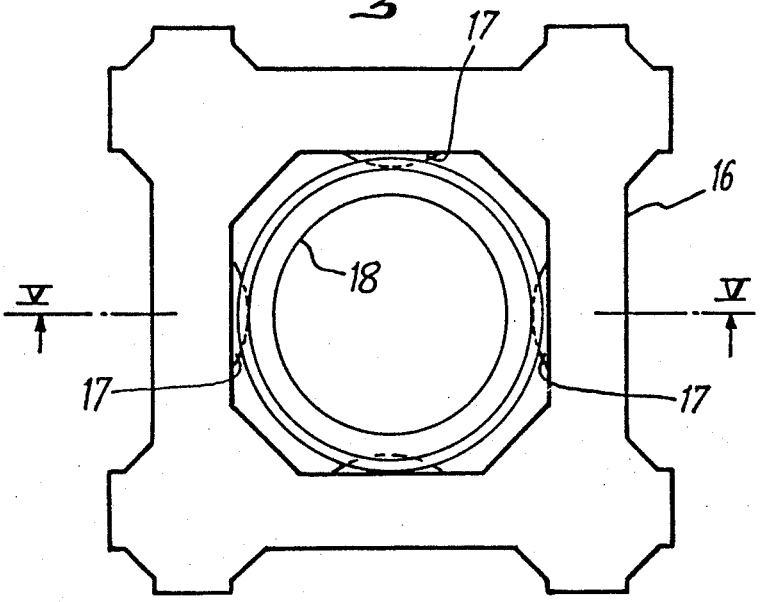
Figure 7:
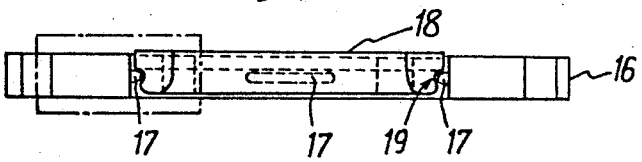
FIG. 7 is a plan view of another example embodiment of the device according to the invention.
Figure 8:
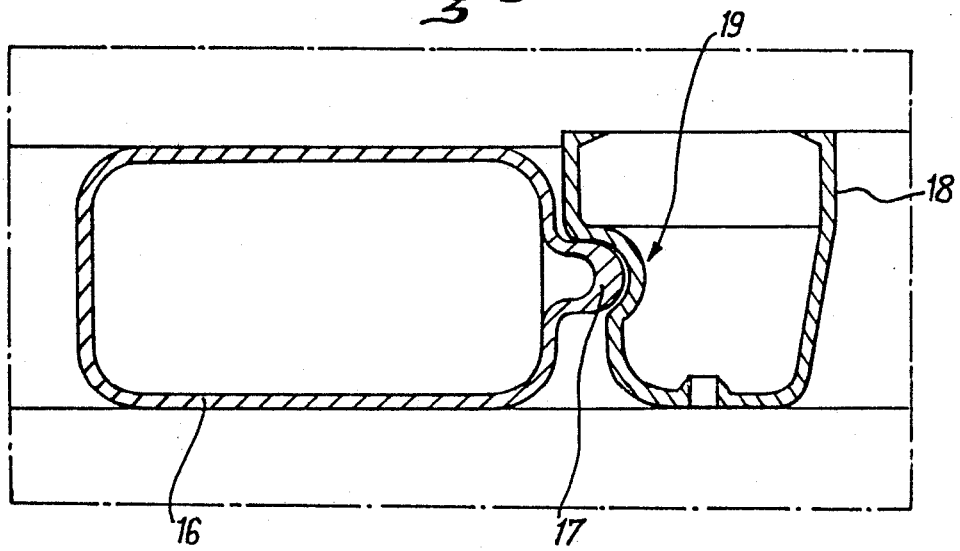
FIG. 8 is an enlarged partial cross-section derived from FIG. 7.

FIGS. 6, 7 and 8 illustrate another embodiment of the present invention. The figures show a rigid element 16 similar to that shown in FIG. 5, but also including four elongated convex surfaces 17 substantially in the middle of the inner sides of said tubes disposed in the form of a square, one convex surface on each tube. The larger dimension of each convex surface is aligned with the longitudinal axes of said tubes. A rigid accessory 18 in the form of annular groove open in the upwards direction and with concentric sides can be locked into the central opening of said rigid element 16 through a groove or recess 19 disposed circumferentially on the outer side of said accessory, and cooperating with said elongated convex surfaces formed on the inner part of said rigid element. To lock said accessory into said element, it is sufficient to present it axially above said element and force it in.

Figure 9:
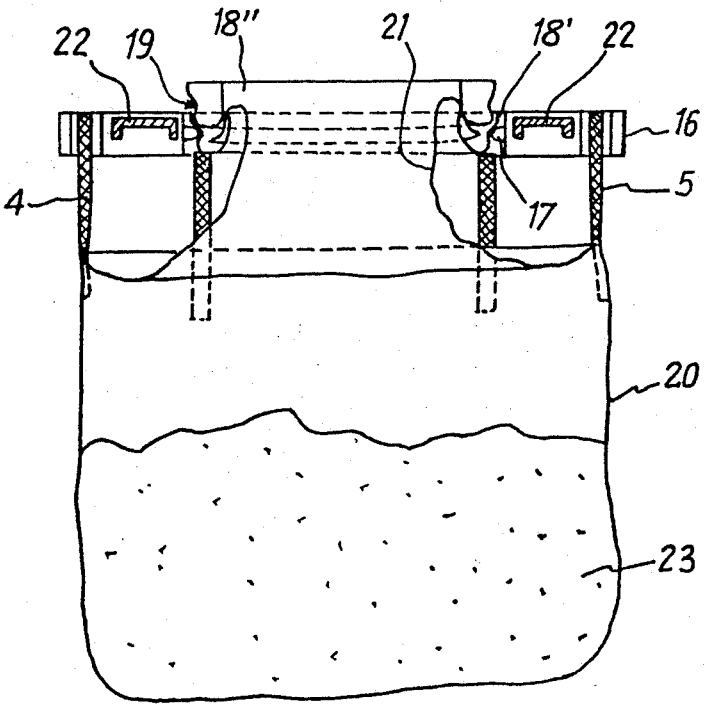
FIG. 9 is a cross-section or view in elevation of a device according to the invention used to fill a bag equipped with funnel.

In FIG. 9, a bag 20 equipped with a funnel 21 is suspended by its straps 4, 5 from the fork elements 22 of a forklift truck—not shown in the figure—through the intermediary of a rigid element 16 as described above with reference to FIGS. 6, 7 and 8. The figure also shows first and second rigid accessories 18' and 18'' both identical to that described with reference to the same figures. The two accessories 18' and 18'' are mutually engaged and wedge between them the upper edge of the funnel 21. This greatly facilitates filling the bag 20 with material 23.

It will also be appreciated by those skilled in the art that the device according to the invention helps the stacking of bags. This is achieved by leaving said rigid element in the straps of the bag.

In addition, it becomes possible through said accessory to robotize the filling of flexible containers. This is one of the most interesting applications of the present invention.

It will be understood that various changes in the details, materials and arrangements of parts, which have been herein described and illustrated in order to explain the nature of the invention, may be made by those skilled in the art within the principle and scope of the invention as expressed in the appended claims.

I claim:

1. A device for maneuvering large capacity bags (1; 20) equipped with lifting straps (2–5), filled with powdered or granular materials, comprising: a substantially flat rigid element (6; 16) defined by at least four hollow, intersecting tubes (11–14) disposed in a square with each tube being open at opposite ends thereof for receiving fork elements of a forklift truck, said tube ends extending beyond the intersections of the tubes to enable the straps of the bags to be passed over them, a rigid toroidal accessory (18) having an outer diameter slightly less than that of a central enabling said rigid element, and locking means (17, 19) for opening of said accessory to be held inscribed in said central opening of said rigid element.

2. A device according to claim 1, fabricated from plastics material.

3. A device according to claim 1, wherein an upper portion of said toroidal accessory is open around the circumference thereof to define an annular groove having substantially concentric sides of different diameters.

4. A device according to claim 1, wherein said locking means comprises a circumferential recess (19) defined in a radially outer part of said accessory, cooperating with protuberances (17) in the form of elongated convex surfaces coplanar with said element, formed on inner sides thereof, and extending radially inwardly.

5. An arrangement for transporting powdered or granular materials, comprising:

(a) a substantially flat rigid element (6; 16) defined by at least four hollow, intersecting tubes (11–14) disposed in a square with each tube being open at opposite ends thereof for receiving fork elements of a forklift truck, said tube ends extending beyond the intersections of the tubes to define four X-shaped support lugs (10), and (b) a large capacity bulk bag (1; 20) having four lifting strap loops (2–5) securely fastened to an upper edge of the bag and equally spaced from one another around said edge, said strap loops being individually disposed over said support lugs such that the bag is exclusively vertically suspended by and hangs downwardly below the rigid element.

* * * * *